US008276806B2

(12) United States Patent
Burke

(10) Patent No.: US 8,276,806 B2
(45) Date of Patent: Oct. 2, 2012

(54) CARTON FOR FLOWABLE MATERIAL

(75) Inventor: Bradley J. Burke, Glendale Heights, IL (US)

(73) Assignee: Graphic Packaging International, Inc., Marietta, GA (US)

( * ) Notice: Subject to any disclaimer, the term of this patent is extended or adjusted under 35 U.S.C. 154(b) by 269 days.

(21) Appl. No.: 12/622,904

(22) Filed: Nov. 20, 2009

(65) Prior Publication Data

US 2010/0127057 A1 May 27, 2010

Related U.S. Application Data

(60) Provisional application No. 61/199,966, filed on Nov. 21, 2008.

(51) Int. Cl.

| | |
|---|---|
| ***B65D 5/46*** | (2006.01) |
| ***B65D 5/00*** | (2006.01) |
| ***B31B 3/00*** | (2006.01) |
| ***B32B 3/10*** | (2006.01) |

(52) U.S. Cl. ..... 229/117.3; 229/122; 222/92

(58) Field of Classification Search ..... 229/117.27, 229/117.3, 185.1, 919, 117.35; 206/163; 220/495.01; 222/462, 106, 93, 460, 181.1
See application file for complete search history.

(56) References Cited

U.S. PATENT DOCUMENTS

| | | | | |
|---|---|---|---|---|
| 3,054,549 | A | | 9/1962 | Humphrey |
| 3,173,579 | A | | 3/1965 | Curie et al. |
| 3,178,242 | A | | 4/1965 | Ellis et al. |
| 3,233,817 | A | | 2/1966 | Casady |
| 3,521,741 | A | | 7/1970 | Beaudry |
| 3,640,380 | A | * | 2/1972 | Huffman ..... 206/549 |
| 3,756,471 | A | | 9/1973 | Wissman |
| 4,069,917 | A | | 1/1978 | Stollberg et al. |
| 4,169,539 | A | | 10/1979 | Price |
| 4,322,018 | A | | 3/1982 | Rutter |
| 4,560,090 | A | | 12/1985 | Okushita |
| D305,304 | S | * | 1/1990 | McCaleb ..... D9/751 |
| 4,919,306 | A | | 4/1990 | Heaps et al. |
| 5,069,359 | A | | 12/1991 | Liebel |
| 5,201,462 | A | | 4/1993 | Sada et al. |
| 5,265,753 | A | | 11/1993 | Moorman |
| 5,482,179 | A | | 1/1996 | Bruhn |
| 5,735,429 | A | | 4/1998 | Whitworth |
| 5,749,489 | A | | 5/1998 | Benner et al. |
| 5,803,346 | A | | 9/1998 | Baker et al. |
| 5,826,752 | A | | 10/1998 | Latimer |
| 5,909,841 | A | * | 6/1999 | Andrews et al. ..... 229/125.15 |
| 6,062,431 | A | * | 5/2000 | Geshay ..... 222/105 |

(Continued)

FOREIGN PATENT DOCUMENTS

CA 2000971 A1 4/1990

(Continued)

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

A carton for dispensing flowable material. The carton has a plurality of panels and end flaps for closing respective ends of the carton. An access opening in one of the panels is for providing access to the interior of the carton. The carton further can include a flexible bag that is positioned in the interior of the carton, and a spigot that is operatively connected to the bag for selectively dispensing the flowable material from the interior of the bag by way of the spigot. The carton is shaped to enhance flow of the flowable material through the spigot.

49 Claims, 17 Drawing Sheets

U.S. PATENT DOCUMENTS

| | | | | |
|---|---|---|---|---|
| 6,637,623 | B2 | 10/2003 | Muise et al. | |
| 6,644,540 | B2 * | 11/2003 | Jamitzky et al. | 229/120.11 |
| 6,648,218 | B2 | 11/2003 | Katsuyama et al. | |
| 6,736,289 | B2 | 5/2004 | Cook et al. | |
| 6,755,324 | B2 | 6/2004 | Geshay | |
| 6,786,394 | B2 | 9/2004 | Prince | |
| 6,854,246 | B2 | 2/2005 | Savage et al. | |
| 7,007,825 | B2 | 3/2006 | Crosland et al. | |
| 7,293,676 | B2 | 11/2007 | Liston et al. | |
| 7,665,894 | B2 | 2/2010 | DeBlander et al. | |
| 7,681,783 | B2 | 3/2010 | Stephenson | |
| 2004/0164136 | A1 | 8/2004 | Harrelson | |
| 2005/0040063 | A1 | 2/2005 | Churvis et al. | |
| 2005/0051611 | A1 | 3/2005 | Ingalls | |
| 2006/0180643 | A1 | 8/2006 | Stephenson | |
| 2006/0243783 | A1 | 11/2006 | Spivey, Sr. et al. | |
| 2008/0267538 | A1 | 10/2008 | Stephenson | |
| 2010/0102112 | A1 | 4/2010 | Ouillette | |

FOREIGN PATENT DOCUMENTS

| | | | |
|---|---|---|---|
| DE | 89 09 888 | U1 | 12/1989 |
| EP | 0 359 968 | A1 | 3/1990 |
| EP | 0 361 042 | A1 | 4/1990 |
| EP | 0 365 941 | A1 | 5/1990 |
| EP | 0 576 333 | A1 | 12/1993 |
| EP | 0 582 532 | A1 | 2/1994 |
| JP | 08282647 | A1 | 10/1996 |
| WO | WO 02/083510 | A1 | 10/2002 |

* cited by examiner

CARTON FOR FLOWABLE MATERIAL

CROSS-REFERENCE TO RELATED APPLICATION

This application claims the benefit of U.S. Provisional Patent Application No. 61/199,966, which was filed on Nov. 21, 2008.

INCORPORATION BY REFERENCE

U.S. Provisional Patent Application No. 61/199,966, which was filed on Nov. 21, 2008, is hereby incorporated by reference for all purposes as if presented herein in its entirety.

BACKGROUND OF THE DISCLOSURE

The present disclosure generally relates to cartons and cartons for holding and dispensing flowable material such as liquid products.

SUMMARY OF THE DISCLOSURE

In general, one aspect of the disclosure is directed to a carton or package for dispensing flowable material. The carton or package has a plurality of panels and end flaps for closing respective ends of the carton. An access opening in one of the panels is for providing access to the interior of the carton. The carton or package further can include a flexible bag that is positioned in the interior of the carton, and a spigot that is operatively connected to the bag for selectively dispensing the flowable material from the interior of the bag by way of the spigot. The carton or package is shaped to enhance flow of the flowable material through the spigot.

In another aspect, the carton can include holding features in at least one of the panels of the carton. The holding features are for holding cups or other complementary products.

In another aspect, the carton can include a funnel for facilitating the flow of fluid into the carton.

In another aspect, the disclosure is generally directed to a carton for holding and dispensing a flowable material. The carton comprises a plurality of panels for at least partially enclosing an interior of the carton. The plurality of panels comprises a front panel having an access opening for accessing the interior, a first side panel foldably connected to the front panel at a first fold line, a second side panel foldably connected to the front panel at a second fold line, and at least one back panel foldably connected to at least one of the first side panel and the second side panel at a third fold line. A fluid dispensing mechanism is positioned relative to the access opening for dispensing the flowable material. Wherein the third fold line is a lateral fold line and at least a portion of the first fold line is curved and at least a portion of the second fold line is curved.

In another aspect, the disclosure is generally directed to a blank for forming a carton for holding and dispensing a flowable material through a fluid dispensing mechanism. The blank comprises a plurality of panels comprising a front panel having an access opening, a first side panel foldably connected to the front panel at a first fold line, a second side panel foldably connected to the front panel at a second fold line, and at least one back panel foldably connected to at least one of the first side panel and the second side panel at a third fold line. The access opening is for positioning of the fluid dispensing mechanism in the carton formed from the blank.

Wherein the third fold line is a lateral fold line and at least a portion of the first fold line is curved and at least a portion of the second fold line is curved.

In another aspect, the disclosure is generally directed to a method of forming a carton for holding and dispensing a flowable material. The method comprises obtaining a blank comprising a plurality of panels comprising a front panel having an access opening, a first side panel foldably connected to the front panel at a first fold line, a second side panel foldably connected to the front panel at a second fold line, and at least one back panel foldably connected to at least one of the first side panel and the second side panel at a third fold line. The third fold line is a lateral fold line and at least a portion of the first fold line is curved and at least a portion of the second fold line is curved. The method comprises positioning the plurality of panels to form an interior space of the carton, and positioning a fluid dispensing mechanism relative to the access opening so that the dispensing mechanism is in fluid communication with interior space of the carton.

Other aspects, features, and details of the present disclosure can be more completely understood by reference to the following detailed description of exemplary embodiments taken in conjunction with the drawings and from the appended claims.

Those skilled in the art will appreciate the above-stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Figure 1:
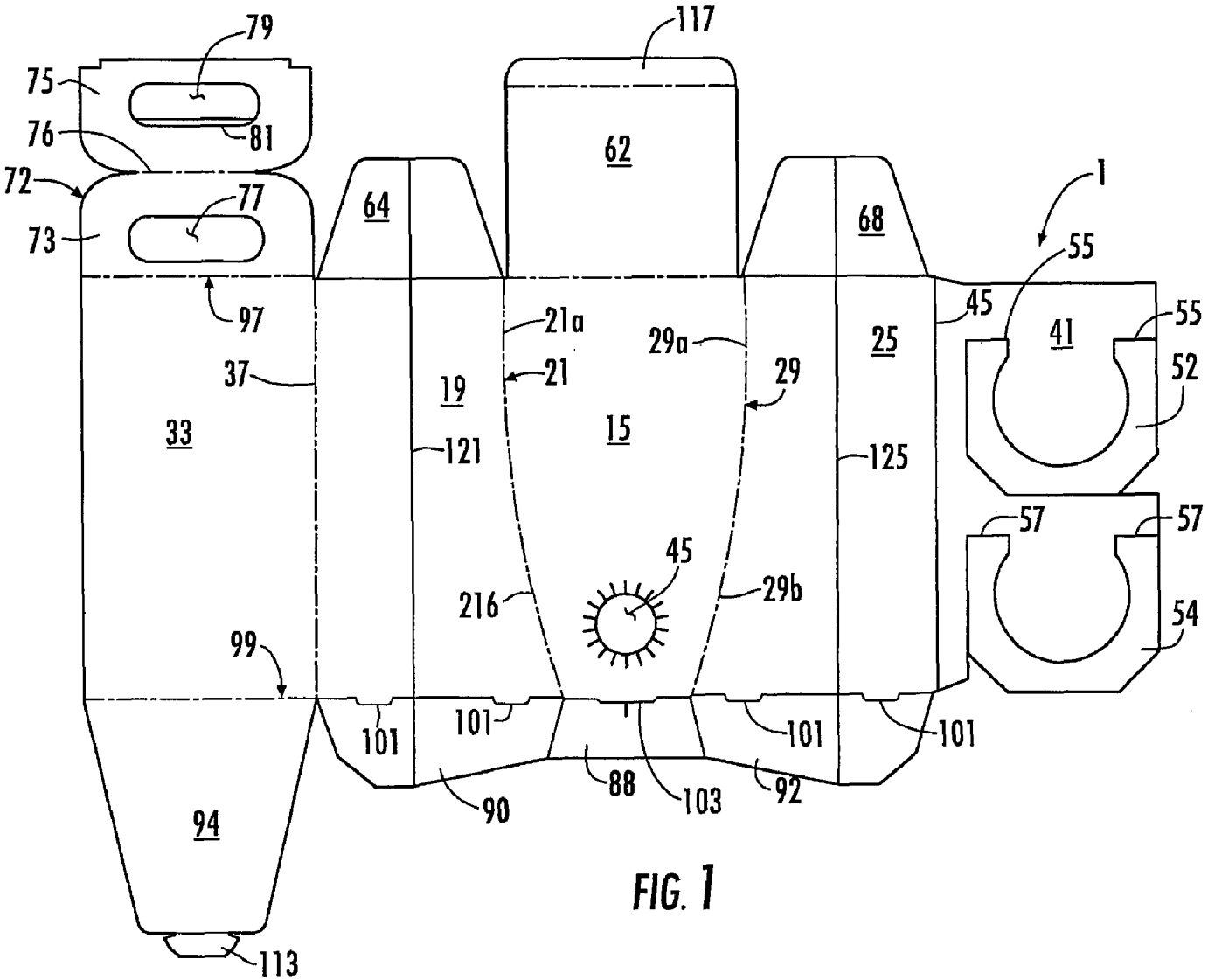
FIGS. 1-4 are various views of various features of a blank, carton, and/or package of a first embodiment of the disclosure.
Figure 2:
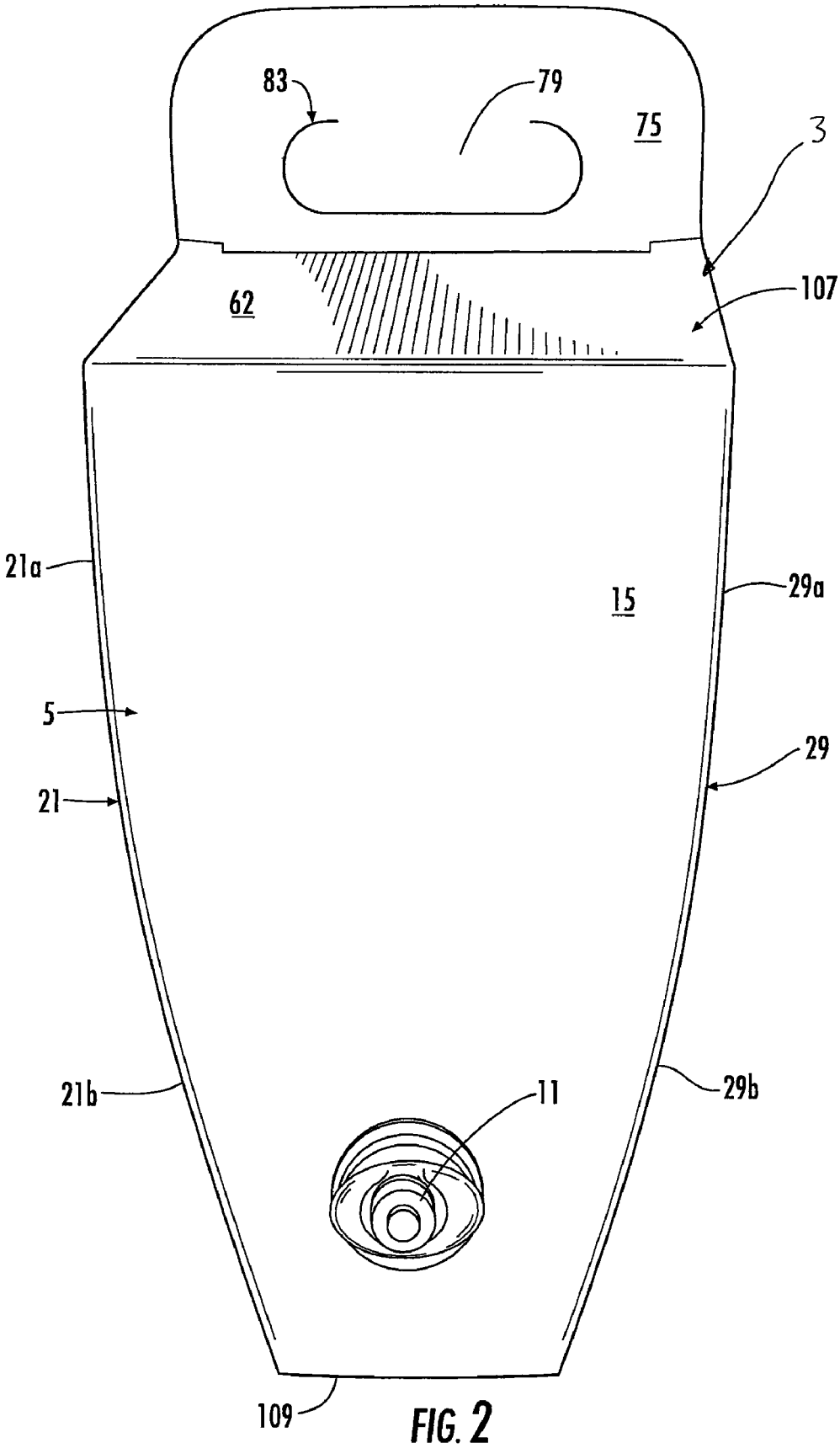

FIG. 1 is a plan view of a blank, generally indicated at 1, used to form a carton 3 forming a package 5 (FIG. 2) of a first embodiment of the disclosure. The carton 3 can be a container that is used to hold a beverage product, e.g., coffee, juice, etc., (not shown), or other flowable material (e.g., other liquid such as soap, detergent, etc., or other flowable material such as fine powders, salts, or other fluid materials). The package 5 can include a flexible bag similar or identical to the flexible bag disclosed in U.S. patent application Ser. No. 11/367,912 filed Mar. 3, 2006, the entire contents of which are incorporated by reference herein for all purposes. Also, the package 5 can have similar or identical features as a JERRIBOX carton that is available from Scholle Packaging of Northlake, Ill. Further, the package 5 can have similar or identical features as other "bag-in-box" type packages or other cartons, packages, or containers. A spigot 11 (broadly "fluid dispensing mechanism") or flow control valve is connected to the bag for controlling flow of the flowable material from the package 5. The spigot 11 protrudes from a surface of the package 5 to allow a consumer to access the flowable material. Alternatively, the carton 3 can include a coating or liner on the inner surface of the carton that prevents leakage of flowable material from the package 5 without the need for a flexible bag.

In the illustrated embodiment, the blank 1 has a longitudinal axis L1 and a lateral axis L2. The blank 1 includes a front panel 15 foldably connected to a first side panel 19 at a first fold line 21, a second side panel 25 foldably connected to the front panel 15 at a second fold line 29. A first back panel 33 is foldably connected to the first side panel 19 at a third fold line 37. A second back panel 41 is foldably connected to the second side panel 25 at a fourth fold line 45.

In the illustrated embodiment, the fold lines 37, 45 are lateral fold lines. In one embodiment, the fold lines 21, 29 have respective first portions 21*a*, 29*a* that extend generally in the lateral direction L2 near a top edge of the blank 1 and respective second portion 21*b*, 29*b* that are curved and extend from the lateral portions to a bottom edge of the blank. Alternatively, the fold lines 21, 29 could be curved along their entire length. The front panel 15 includes a circular opening 45 that is positioned near a bottom edge of the blank. 1. In one embodiment, the opening 45 is spaced equidistant from a respective curved portion 21*b*, 29*b* of the fold lines 21, 29. The opening 45 could be otherwise shaped, arranged, configured, or could be omitted, without departing from the disclosure. For example, the opening 45 could be replaced with a removable panel or flap that is attached to the blank 1 by a line of weakening (e.g., tear line or fold line) without departing from this disclosure.

In the embodiment of FIG. 1, the second back panel 41 includes an upper retention flap 52 and a lower retention flap 54. Each retention flap 52, 54 is generally U-shaped and is foldably connected to the second back panel 41 at a respective fold lines 55, 57. As shown in FIG. 1, the fold lines 55, 57 are longitudinal fold lines, but the retention flaps 52, 54 and fold lines could be otherwise shaped and arranged without departing from the disclosure. Further, one or both of the retention flaps 52, 54 and/or second back panel 41 could be omitted without departing from the disclosure.

The blank 1 includes a first top end flap 62 foldably connected to the front panel 15, a second top end flap 64 foldably connected to the first side panel 19, a third top end flap 68 foldably connected to the second side panel 25, and a fourth top end flap 72 foldably connected to the first back panel 33. In the illustrated embodiment, the fourth top end flap 72 comprises handle features that include a first handle portion 73 foldably connected to a second handle portion 75 at a longitudinal fold line 76 and having an elongate handle opening 77. The handle features comprises the second handle portion 75 that includes a handle flap 79 foldably connected to the blank 1 at a longitudinal fold line 81. The handle features including the handle portion 73 and handle opening 77 are for forming a handle 83 (FIG. 2) in the carton 3. The handle 83 could be omitted or could be otherwise shaped arranged or configured without departing from the disclosure.

In the illustrated embodiment, the blank 1 includes bottom end flaps 88, 90, 92, 94 respectively foldably connected to the front panel 15, first and second side panels 19, 25, and first back panel 33 at a lower marginal portion of the blank. The top end flaps 62, 64, 68, 72 are foldably connected to the blank 1 at a longitudinal fold line 97 at a first marginal area of the blank. The bottom end flaps 88, 90, 92, 94 are foldably connected to the blank 1 at a longitudinal fold line 99 at a second marginal area of the blank. The fold lines 97, 99 could be offset or otherwise shaped and can connect features (e.g., cuts or slits 101, 103, etc.) without departing from the disclosure. The top end flaps 62, 64, 68, 72 are for being at least partially overlapped to close a top end 107 (FIG. 2) of the carton 3. The bottom end flaps 88, 90, 92, 94 are for being at least partially overlapped to close a bottom end 109 (FIG. 2) of the carton 3.

In the illustrated embodiment, the bottom end flap 94 connected to the first back panel 33 includes a male locking flap 113 and the slit 103, between the bottom end flap 88 and front panel 15, is a female locking opening that is shaped to receive the male locking flap when the bottom end 109 is closed. The top end flap 62 connected to the front panel 15 includes a foldable flap 117 for securing the top end flaps in the closed position. The top end flaps 62, 64, 68, 72 and/or the bottom end flaps 88, 90, 92, 94 could include other closing or locking features without departing from this disclosure.

In one embodiment, the blank 1 includes a lateral fold line 121 that extends from an edge of the top end flap 64, extends across the top end flap 64, intersects the fold line 97, extends across the first side panel 19, intersects the fold line 99, extends across the bottom end flap 90, and extends to an edge of the bottom end flap 90. Similarly, a lateral fold line 125 extends from an edge of the top end flap 68, extends across the top end flap 68, intersects the longitudinal fold line 97, extends across the second side panel 25, intersects the longitudinal fold line 99, extends across the bottom end flap 92, and extends to an edge of the bottom end flap 92.

In one embodiment, the carton 3 can be at least partially formed from the blank 1 by folding along fold lines 21, 29, 37, and 45 to form a generally open-ended sleeve with the second back panel 41 overlapping the first back panel 33. The second back panel 41 can be adhesively attached to the first back panel 33 by applying glue to portions of the second back panel and/or portions of the first back panel. The top end flaps 62, 64, 68 can be overlapped to close the top 107 of the carton 3, and the bottom end flaps 88, 90, 92, 94, can be overlapped to close the bottom 109 of the carton 3. The top end flaps 62, 64, 68, and/or bottom end flaps 88, 90, 92, 94 can have respective locking feature for securing the top and bottom ends 107, 109 in the closed configuration. Other end closing steps can be used to close the carton 3 without departing from this disclosure.

In the first embodiment, the top end flap 72 connected to the first back panel 33 is not overlapped to form the closed top 107 of the carton 3. Rather, the handle 83 of the carton 3 is formed by folding the second handle portion 75 at fold line 76 to bring the second handle portion in generally face-to-face contact with the first handle portion 73. The handle flap 79 can be folded at fold line 81 to position the handle flap in the handle opening 77. The handle 83 could include other features or be otherwise shaped, arranged, and/or positioned without departing from the disclosure.

The bag for containing the flowable material can be placed in the carton 3 after forming the open-ended sleeve and prior to closing the ends 107, 109 of the carton. Alternatively, the ends 107, 109 can be closed and a cartridge containing the bag and spout can be placed in the carton 3. After placing the bag in the carton 3, a short pulse of air can be used to expand the bag in the interior of the carton 3 so that the bag lines the interior of the carton. Next, the carton can be filled with flowable material (e.g., liquid) by filling the bag. The package 5 that comprises the filled carton 3 can be shipped to a customer such as a restaurant or other point-of-sale location with the flowable product held within the carton. Alternatively, the carton 3 can be shipped to the point-of-sale location prior to filling the carton with flowable material, or the carton can be refilled with flowable material after emptying of the contents of the package 5.

Figure 3:
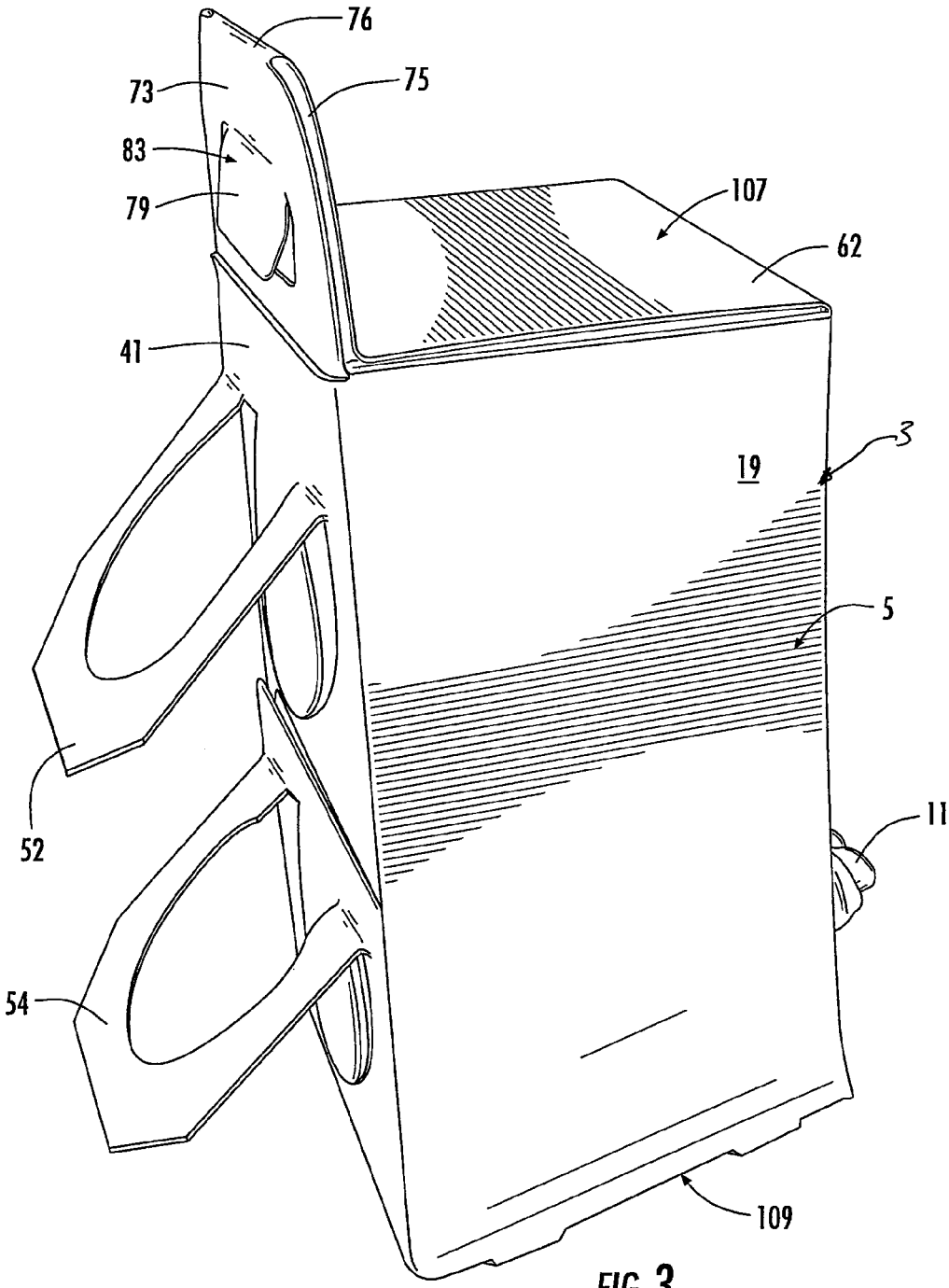
Figure 4:
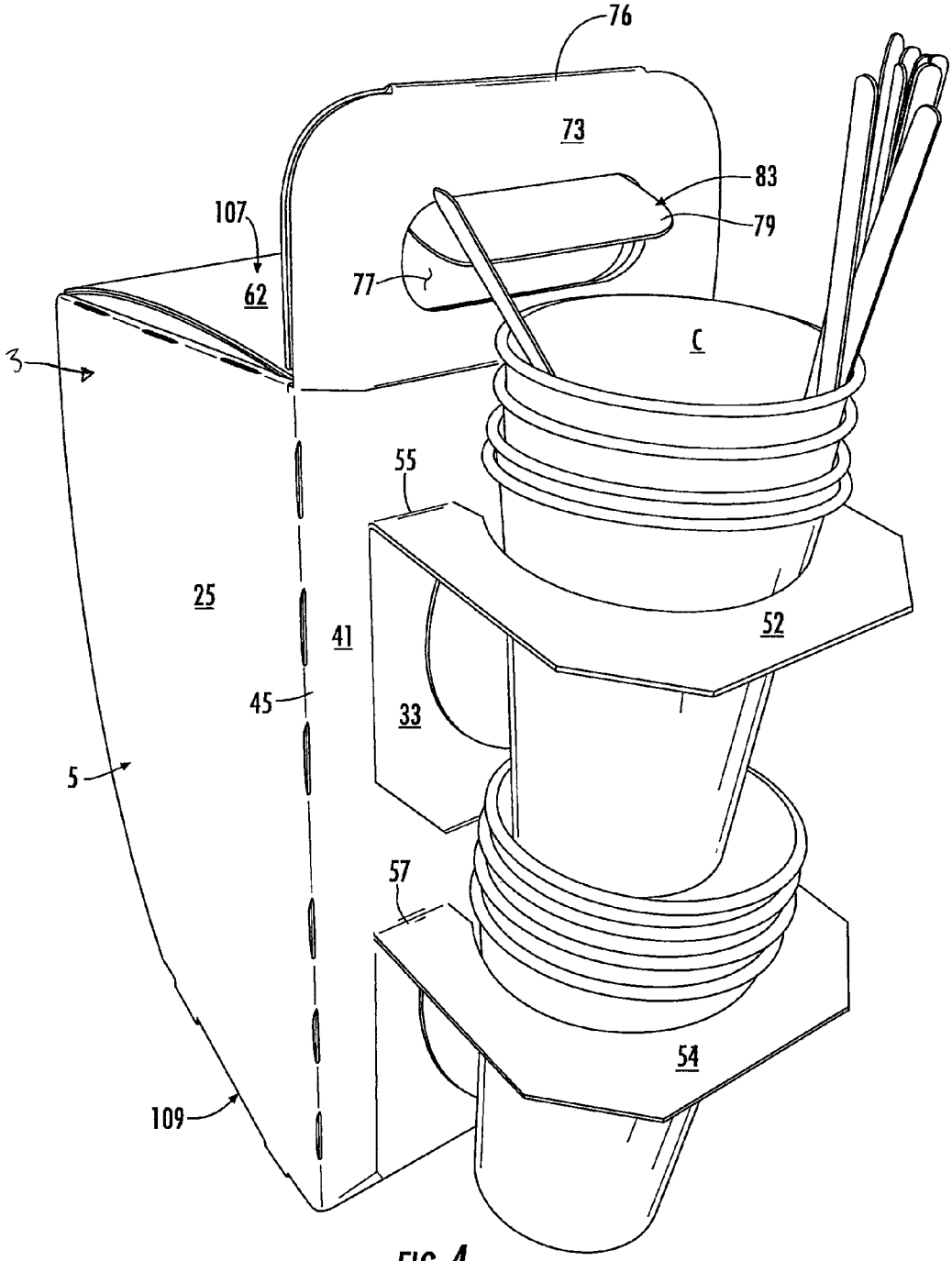

After the carton 3 is filled, the flowable material is dispensed from the carton by actuating the spigot 11. As shown in FIG. 3, the upper and lower retention flaps 52, 54 can be raised by upwardly folding the retention flaps at respective fold lines 55, 57 in the second back panel 41. As shown in FIG. 4, the upwardly folded retention flaps 52, 54 can be used to hold containers C (e.g., beverage containers or cups) or other items (e.g., stir sticks, sugar packets, cartons of sweetener, cartons of coffee creamer, etc.) that are complimentary products used by the consumer to hold, access, and/or consume the flowable food product dispensed from the spigot 11.

Figure 5:
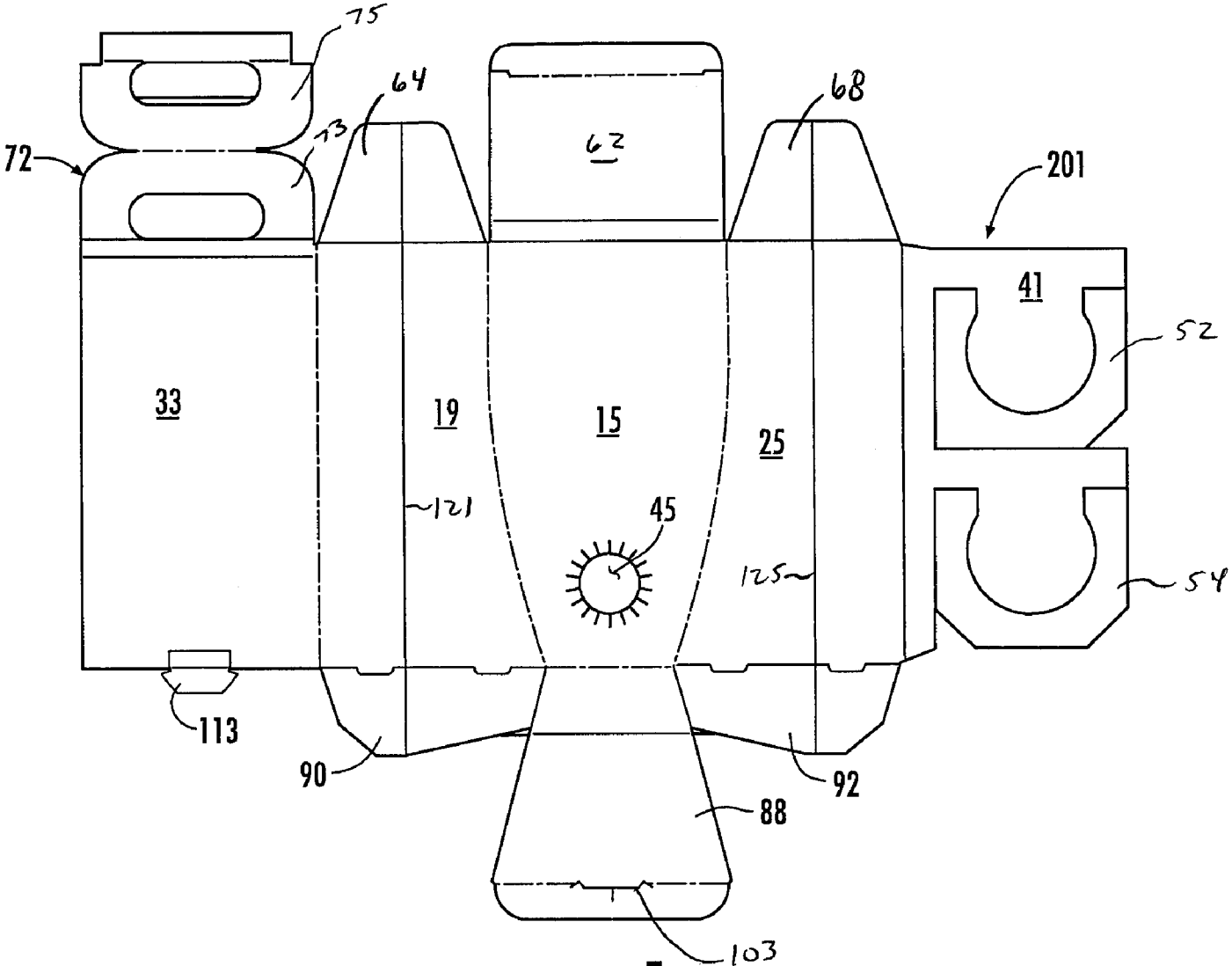
FIG. 5 is a plan view of an exterior surface of a blank having various features of a second embodiment of the disclosure.

FIG. 5 shows a second embodiment of a blank 201 that is similar to the blank 1 of the first embodiment. Accordingly, similar or identical features of the embodiments are provided with like or similar reference numbers. The blank 201 includes a bottom end flap 88 foldably connected to the front panel 15 that is larger than the corresponding bottom end flap of the first embodiment. Further, the male locking flap 113 of the second embodiment is foldably connected to the first back panel 33 such that the bottom end flap 94 is omitted from the blank 201 of the second embodiment. The blank 201 could have other features and could be otherwise shaped, arranged, and/or configured without departing from this disclosure.

Figure 6:
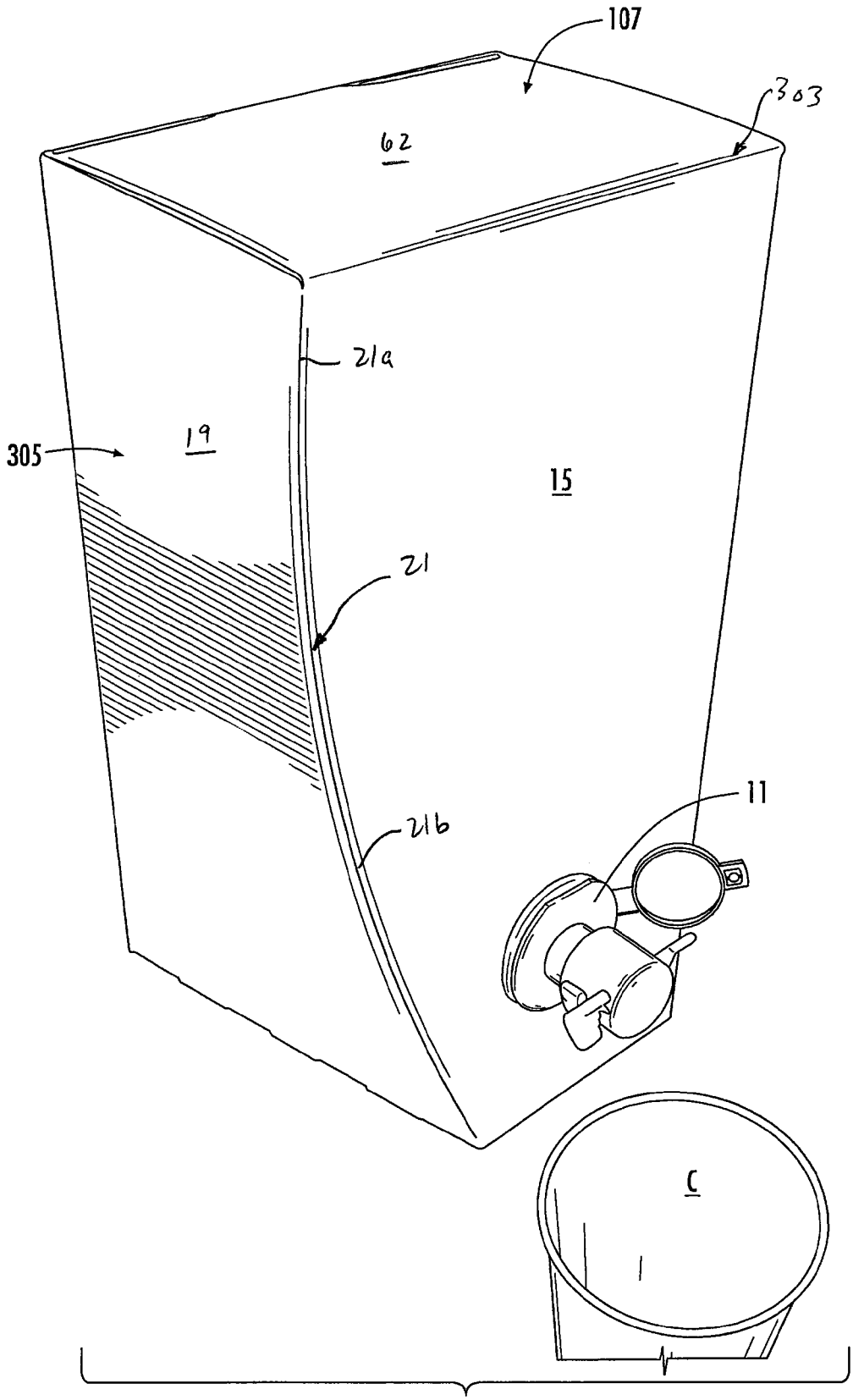
FIG. 6 is a perspective view of a carton having various features of a third embodiment of the disclosure.

FIG. 6 illustrates a carton 303 and a package 305 according to a third embodiment of the disclosure. The carton 303 is similar to the cartons of the previous embodiments and is formed from a blank having similar features as the blanks 1, 201 of the previous embodiments. Accordingly, similar or identical features of the embodiments are provided with like or similar reference numbers. The carton 303 includes a top 107 that is free from a handle 83 formed from handle panels 73, 75 that extend above the overlapped top end flaps. Rather, the top end flap 62 that is connected to the front panel 15 overlaps and the other top end flap (not shown) connected to the back panel 33, side panel 19, and second side panel 25. Also, the carton 303 does not have a second back panel 41 as shown in the first embodiment. The carton 303 could have other features and could be otherwise shaped, arranged, and/or configured without departing from the disclosure.

Figure 7:
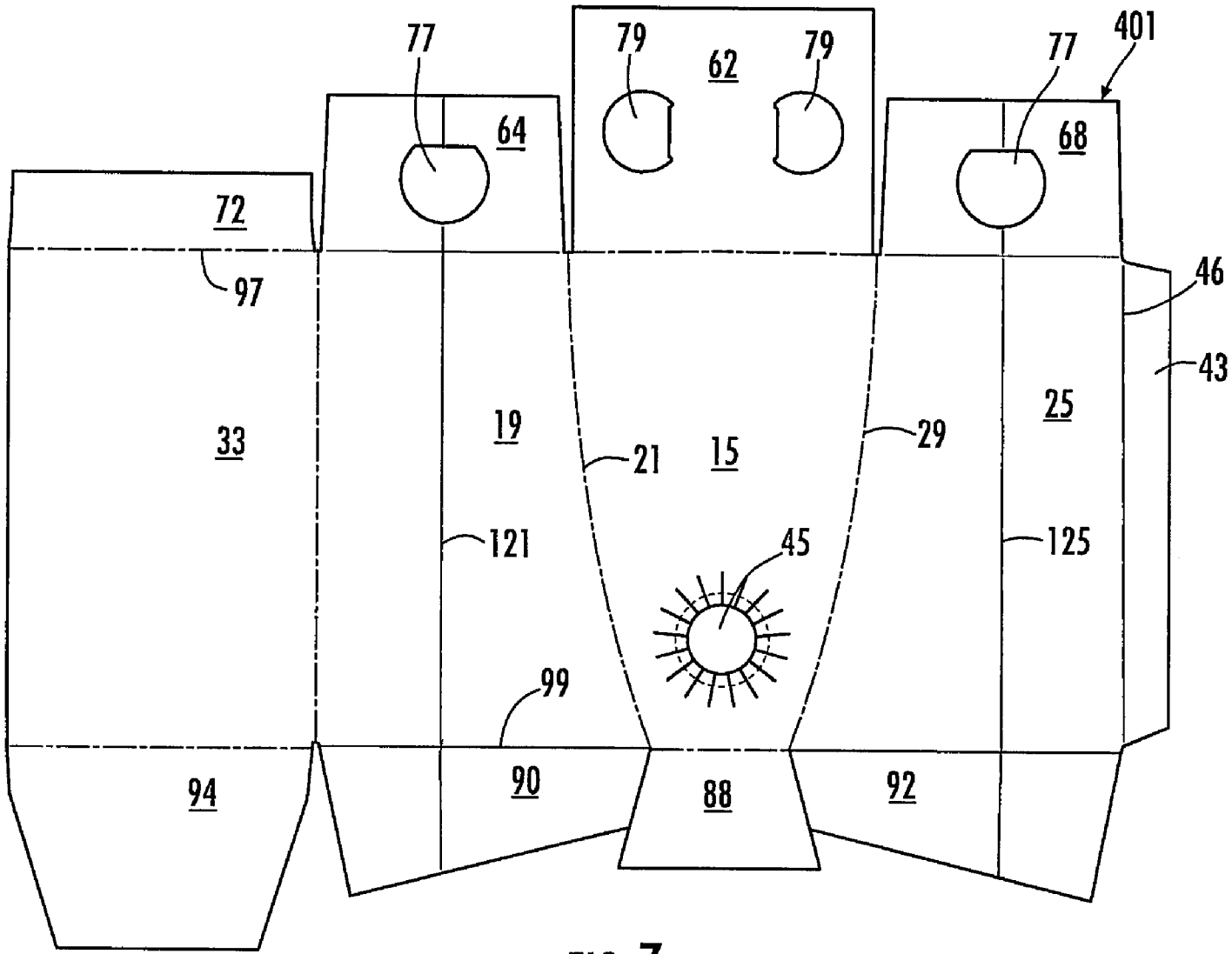
FIGS. 7 and 8 are views of various features of a fourth embodiment of the disclosure.
Figure 8:
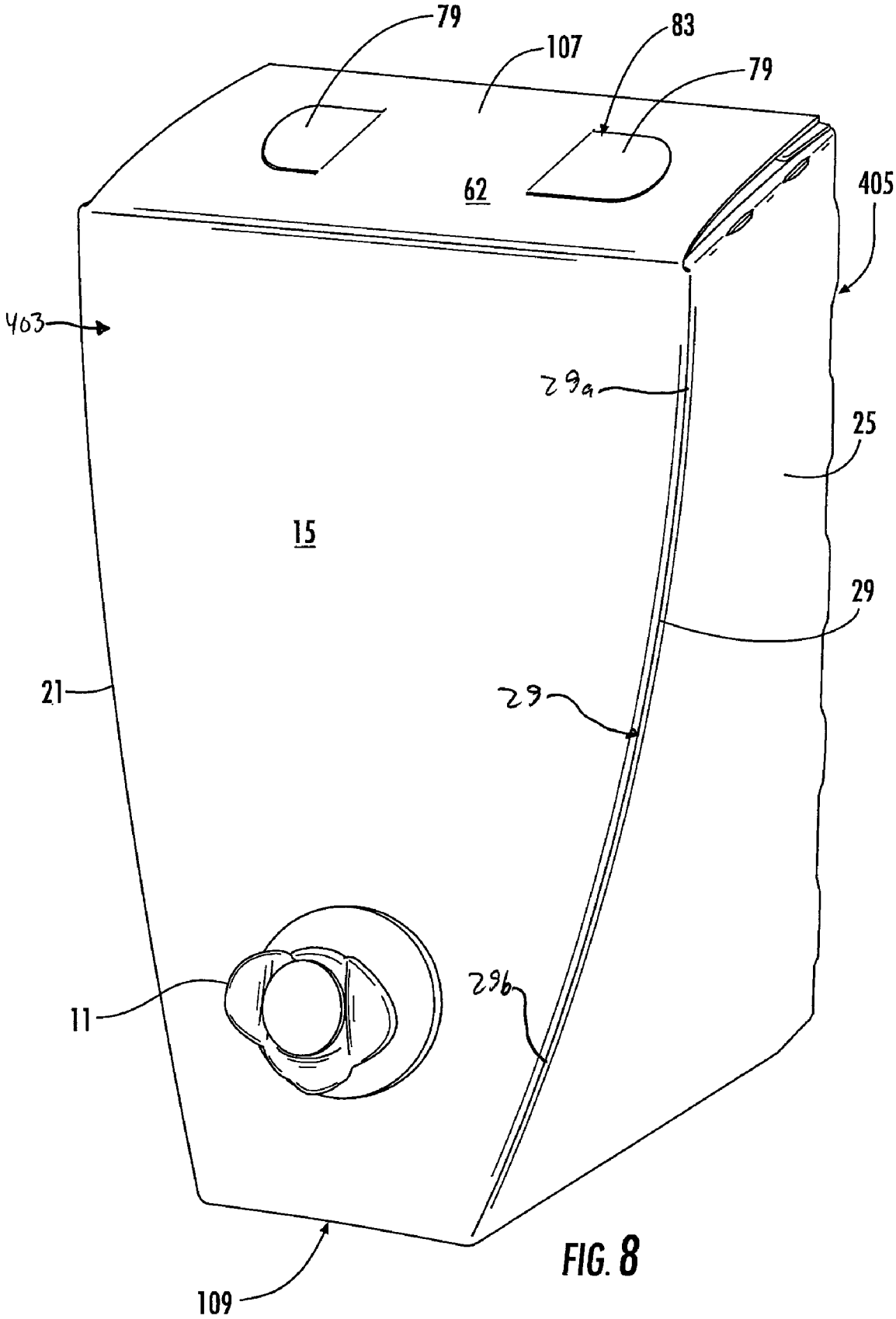

FIG. 7 illustrates a fourth embodiment of a blank 401 for forming a carton 403 and package 405 (FIG. 8) that is similar to the blank and/or cartons of the previous embodiments. Accordingly, similar or identical features of the embodiments are provided with like or similar reference numbers. In the embodiment of FIGS. 7 and 8, the blank 401 includes a single back panel 33 and the cup-holding features of the second back panel 41 of the previous embodiments are omitted. An adhesive flap 43 is foldably connected to the second side panel at a fold line 46 and is for attachment to the back panel 33 to form the open-ended sleeve. Further, the fold lines 21, 29 are curved along substantially the entire lengths of the fold lines between the longitudinal fold lines 97, 99. The top end flaps 62, 64, 68, 72 can be overlapped and can be secured by adhesive to close the top 107 of the carton 403. Further, the top 107 of the carton 403 includes a handle 83 in the form of handle flaps 79 foldably connected to the top end flap 62 and opening 77 in the top end flaps 64, 68. The blank 401 and/or carton 403 could be otherwise shaped, arranged, and/or configured without departing from the disclosure.

Figure 9:
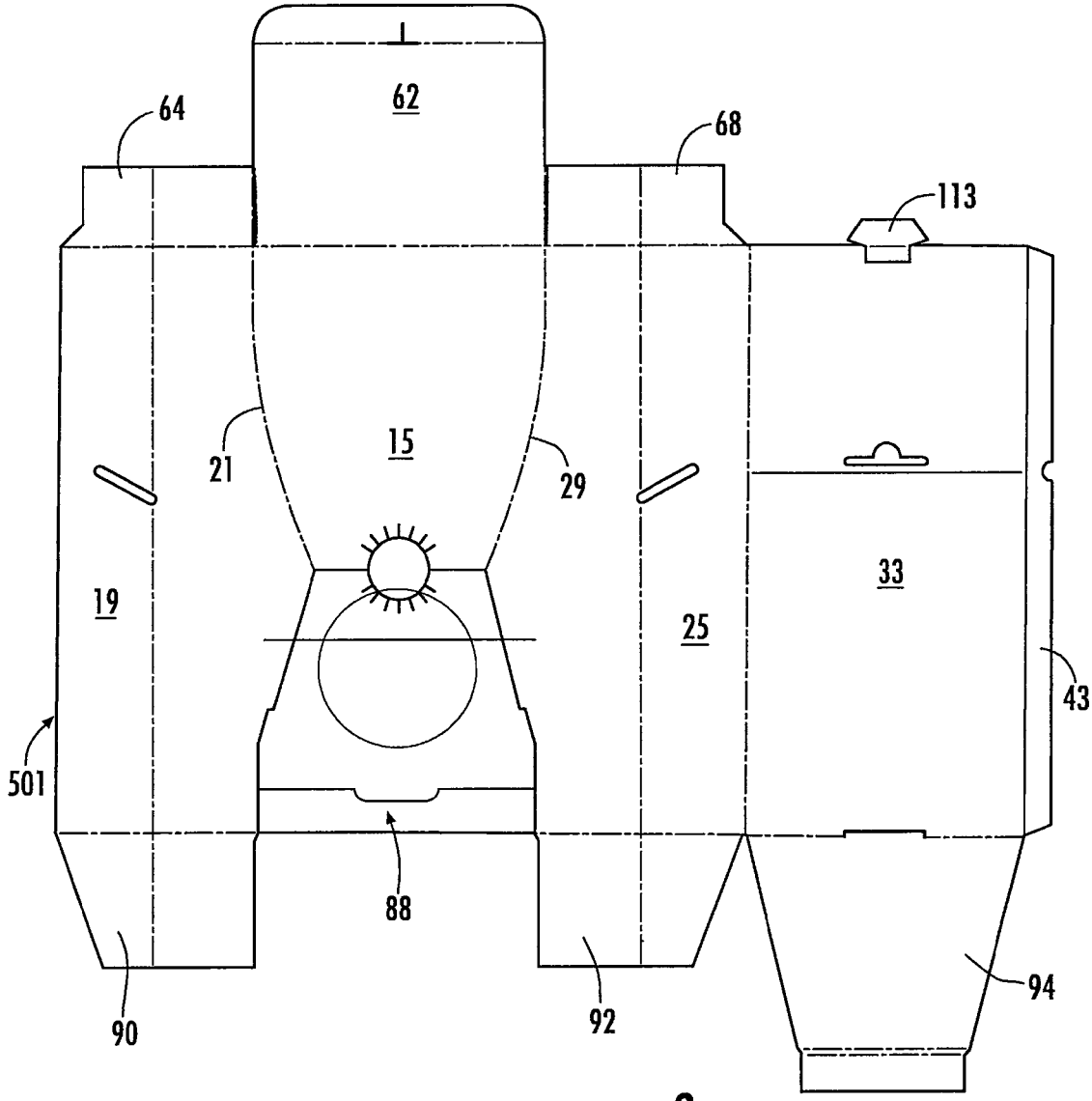
FIG. 9 is a plan view of the exterior surface of a blank having various features of a fifth embodiment of the disclosure.
Figure 10:
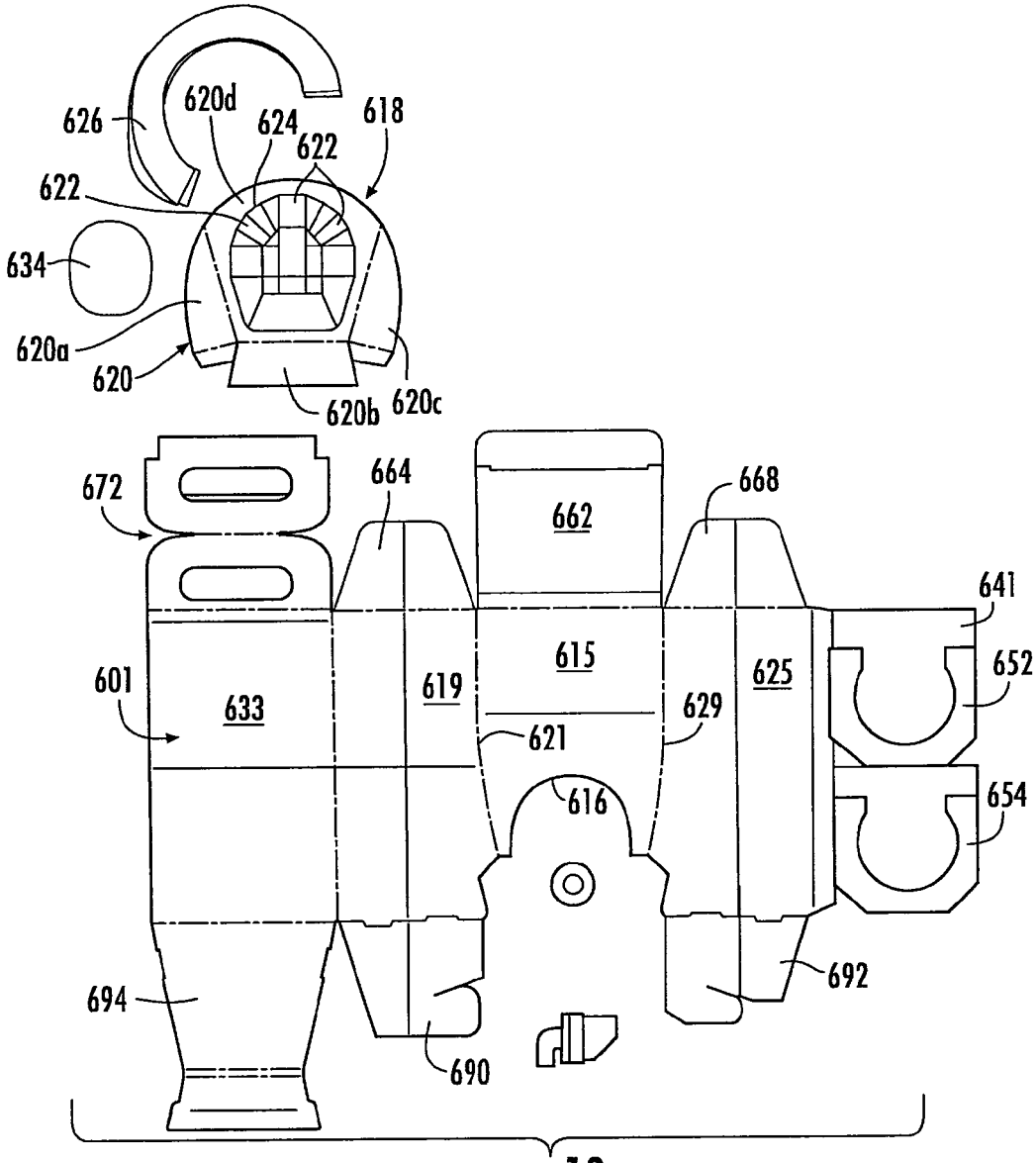
FIGS. 10-15 are various views of various features of a sixth embodiment of the disclosure.
Figure 11:
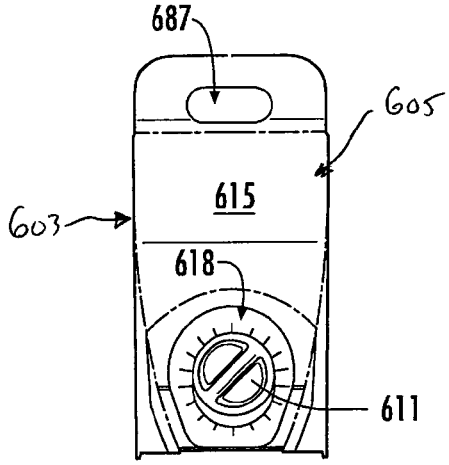
Figure 12:
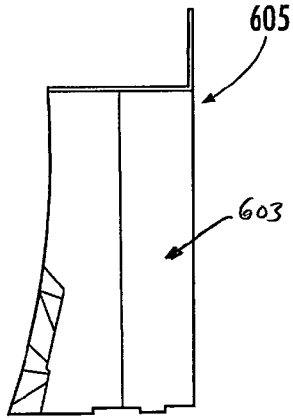
Figure 13:
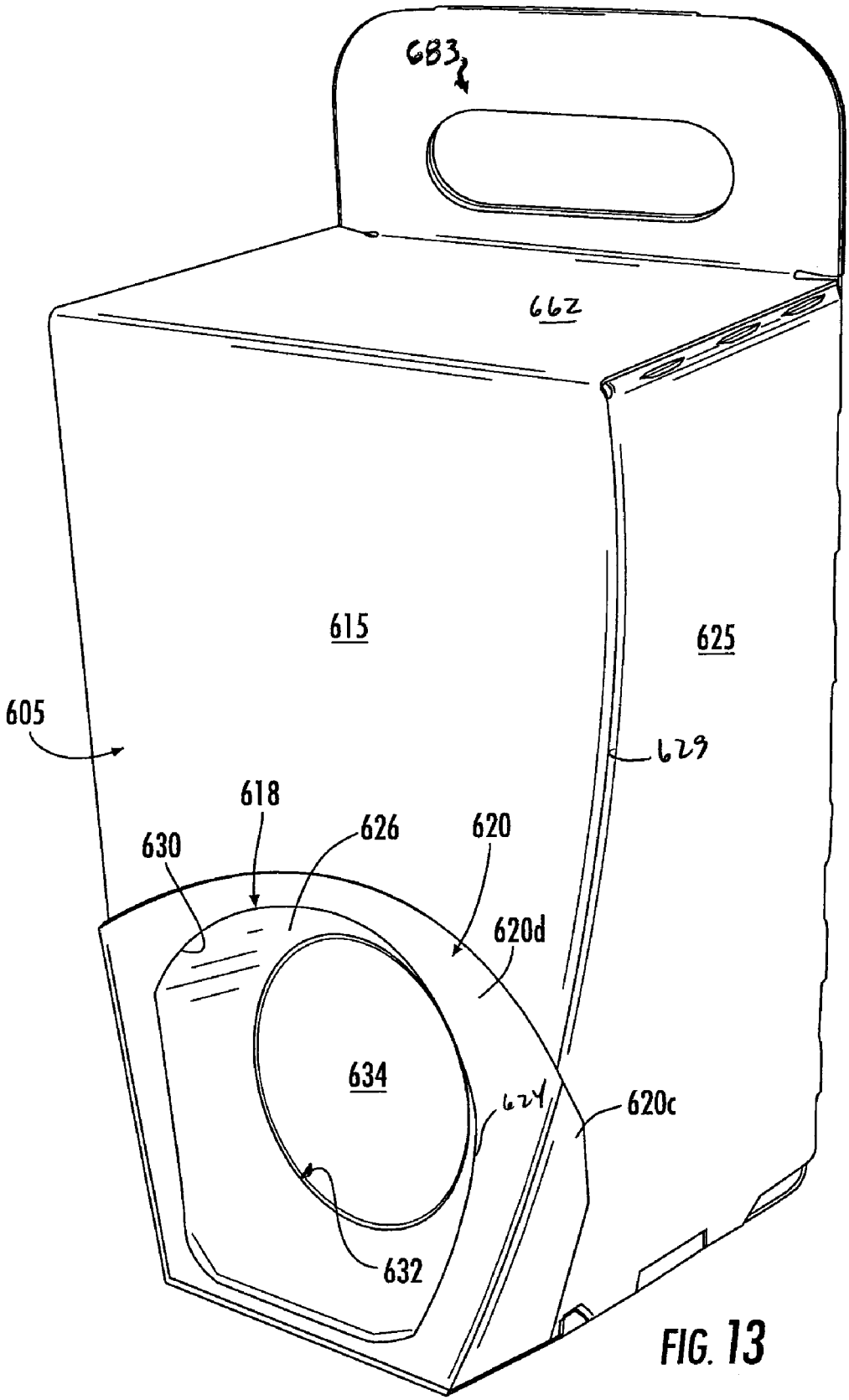
Figure 14:
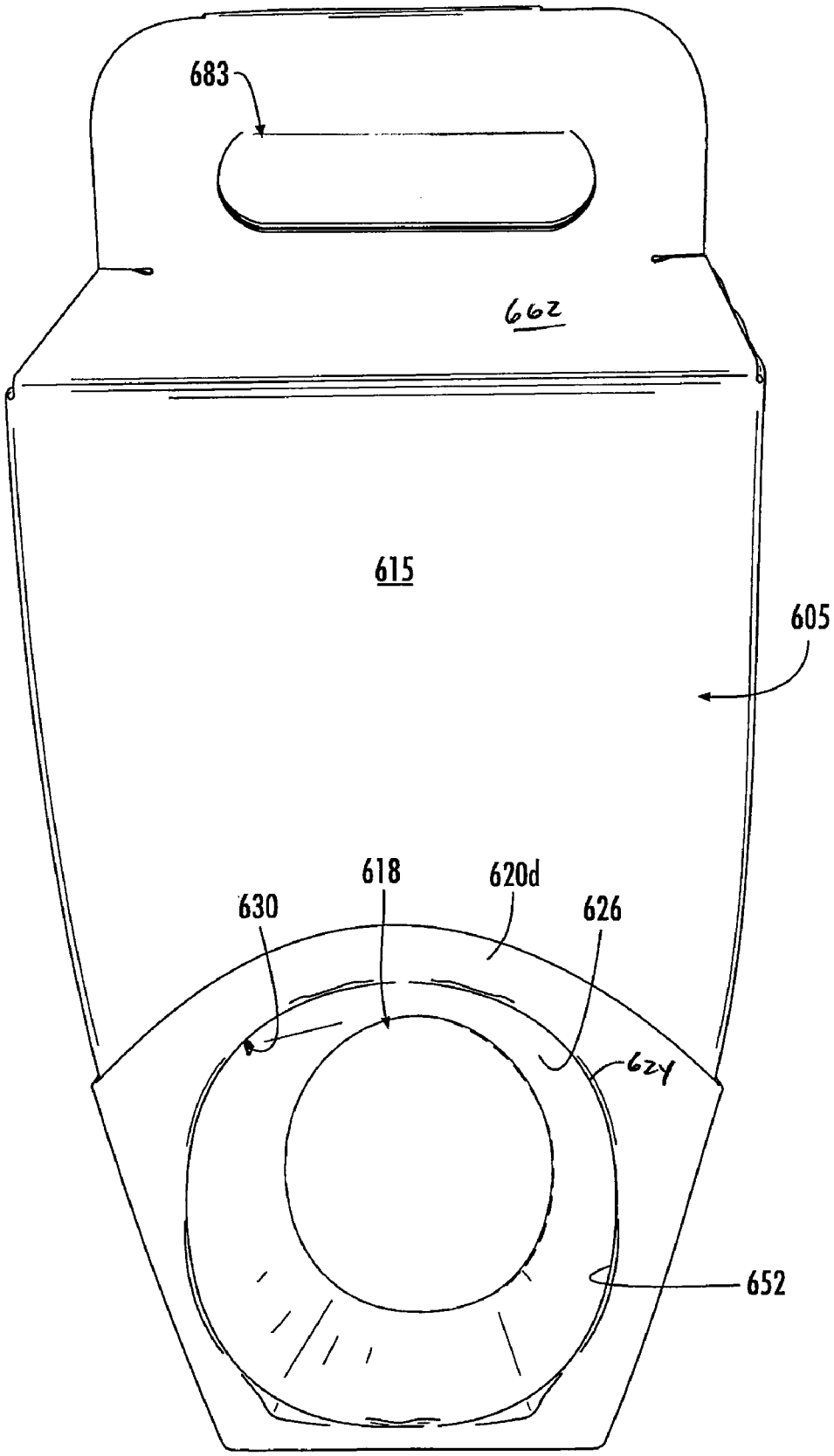
Figure 15:
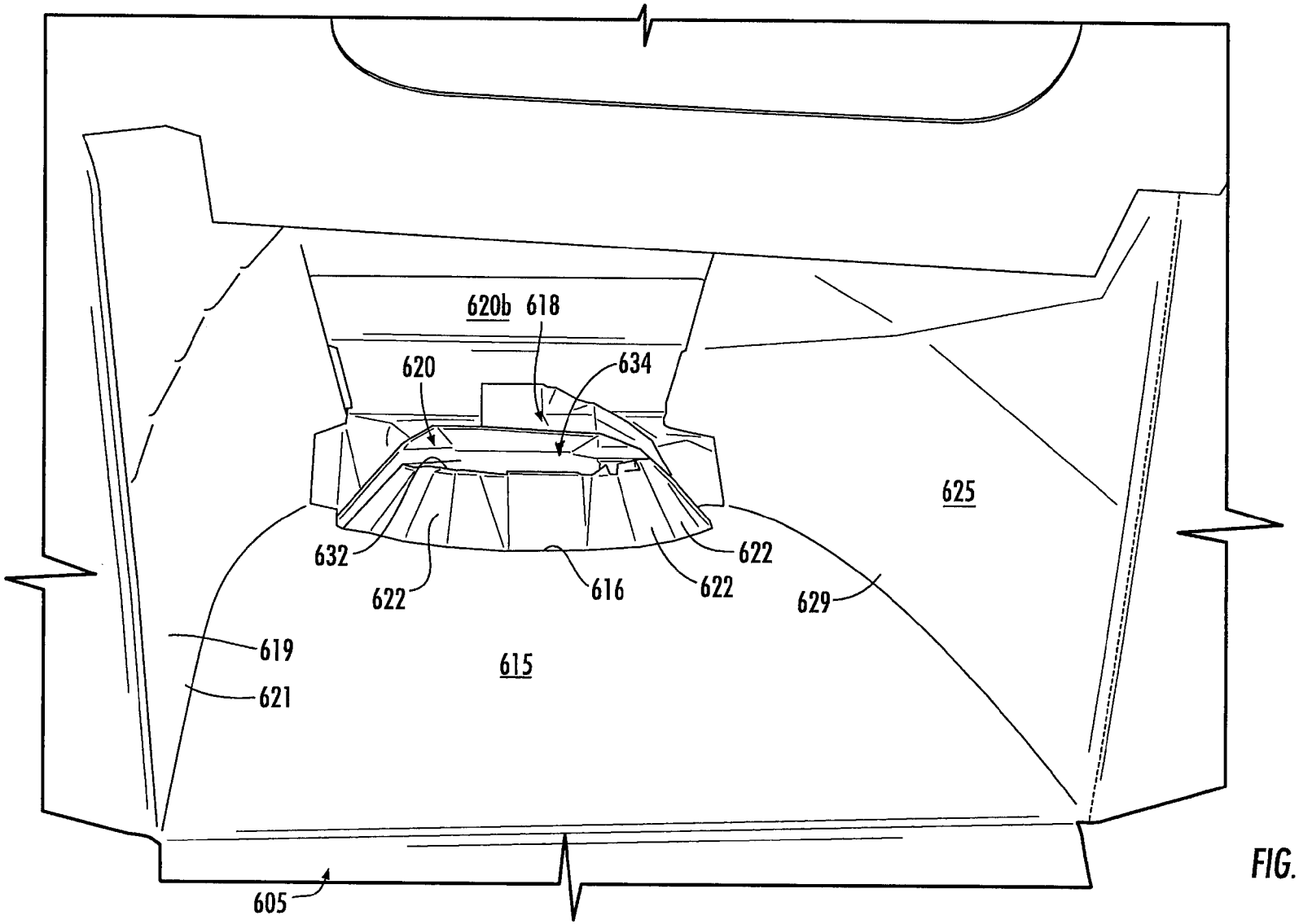

FIG. 9 illustrates a fifth embodiment of a blank 501 for forming a carton and a package similar to the previous embodiments. Accordingly, similar or identical features of the embodiments are provided with like or similar reference numbers. The blank 501 includes a front panel 15 foldably connected to a bottom end flap 88 that is configured for forming a storage compartment below the spigot 11. The blank 501 could be otherwise shaped, arranged, and/or configured without departing from the disclosure.

FIGS. 10-15 illustrate a sixth embodiment of a blank 601 for forming a carton 603 and a package 605 that is similar to the previous embodiments. Accordingly, similar or identical features of the embodiments are provided with like or similar reference numbers. The carton 603 includes an injection-molded push/pull fitment 611 (FIG. 14) that is a different configuration than the spigot 11 of the previous embodiment. The blank comprises a front panel 615, a first side panel 619, a second side panel 625, a first back panel 633, a second pack panel 641, fold lines 621, 629, top end flaps 662, 664, 668, 672, bottom end flaps 690, 692, 694, and retention flaps 652, 654. The carton 603 has a handle 683. The front panel 615 of the blank 601 includes a curved bottom edge 616 (broadly "access opening") that is free from connection to a bottom end flap. The carton 603 includes a funnel 618 attached to the front panel 615, adjacent the bottom edge 616. In one embodiment, the funnel 618 comprises an intermediate panel 620 that has fingers 622 foldably connected to a curved fold line 624. The intermediate panel 620 includes flaps **620*a*, 620*b*, 620*c* foldably connected to a central portion 620*d* of the intermediate panel. A collar 626 fits over the fingers 622 when the funnel 618 is assembled and attached to the front panel 615**.

The blank 601 is assembled into the carton 603 and the package 605 in a similar manner as described above for the previous embodiments. As shown in FIGS. 11-15 the funnel 618 is assembled by placing the intermediate panel 620 on the front panel 615 such that the fold line 624 generally overlays the curved edge 616 of the front panel 615. Portions of the central panel **620*d* overlay a portion of the front panel 615. The flap 620*a* overlays a portion of the first side panel 619. The flap 620*c* overlays a portion of the second side panel 625. The flap 620*b* overlays a portion of the bottom end flap 694 of the carton 603. The collar 626 is placed in contact with the fingers 622 so that the fingers and the collar are pressed inward so that the collar forms an external surface of the carton 603 that angles inward from the outer surface of the central portion 620*d* to the interior surface of the carton 603. The inwardly pressed fingers 622 and overlaying collar 626 form the funnel 618 that allows liquids to be more easily poured into the carton 603 from the exterior surface of the front panel 615. The funnel 618 has a first, larger opening 630 at the exterior surface of the central portion 620*d* with the collar 626 and fingers 622 being positioned to angle inward to form the second, smaller opening 632 of the funnel that is located inward from the front panel 615. In the illustrated embodiment, a cover 634 is placed in the second opening 632. The push/pull fitment 611 that is connected to the bag is located at the second opening 632 of the funnel 618 to allow flow control of the fluids from the carton 603**.

The funnel 618 facilitates the transfer of fluids into the carton 603 when the carton is refilled after removing the contents of the package 605. The fluids that reach the first opening 630 are funneled into the carton 603 by the sloping collar 620 that covers the inwardly folded fingers 622. The carton 605, blank 601, and/or funnel 618 could be otherwise shaped, arranged, and/or configured without departing from the disclosure.

Figure 16:
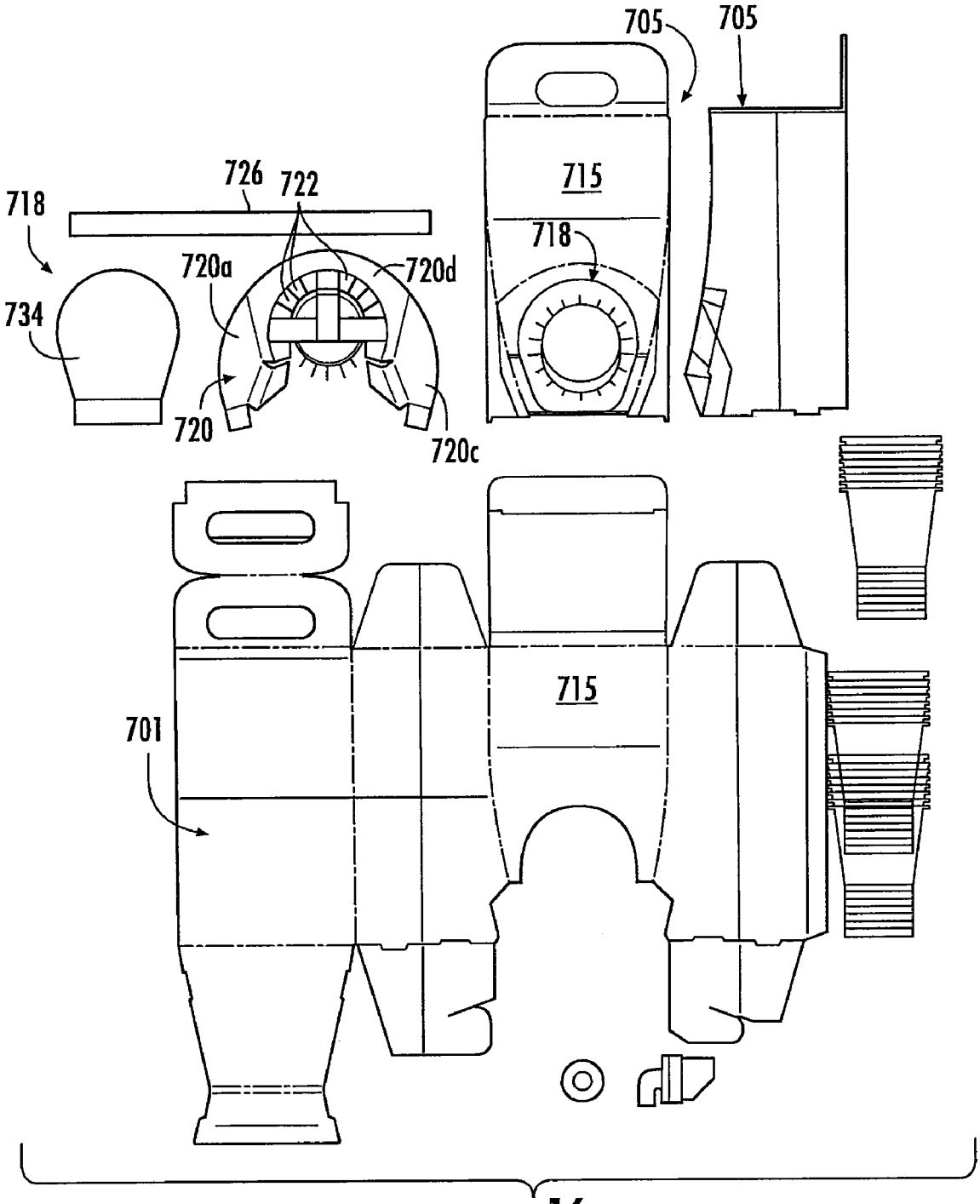
FIG. 16 is a view of various features of a seventh embodiment of the disclosure.

FIG. 16 illustrates a seventh embodiment of a blank 701 used to form a carton 703 and a package 705. This embodiment is similar to the sixth embodiment. Accordingly, like or similar features are indicated by like or similar reference numbers. The blank 701 comprises a front panel 715, and a funnel 718 attached to the front panel. The funnel 718 of the seventh embodiment includes an intermediate panel 720, a collar 726, and a cover 734. The funnel 718 functions in a similar manner as the funnel 618. That is, the funnel 718 facilitates transfer of fluids into the carton 703 when the carton is refilled. In the embodiment of FIG. 16, the fingers 722, the flaps 720*a*, 720*c*, the collar 726, and the cover 734 have a different shape and configuration than the corresponding features of the embodiment of FIGS. 10-15.

Figure 17:
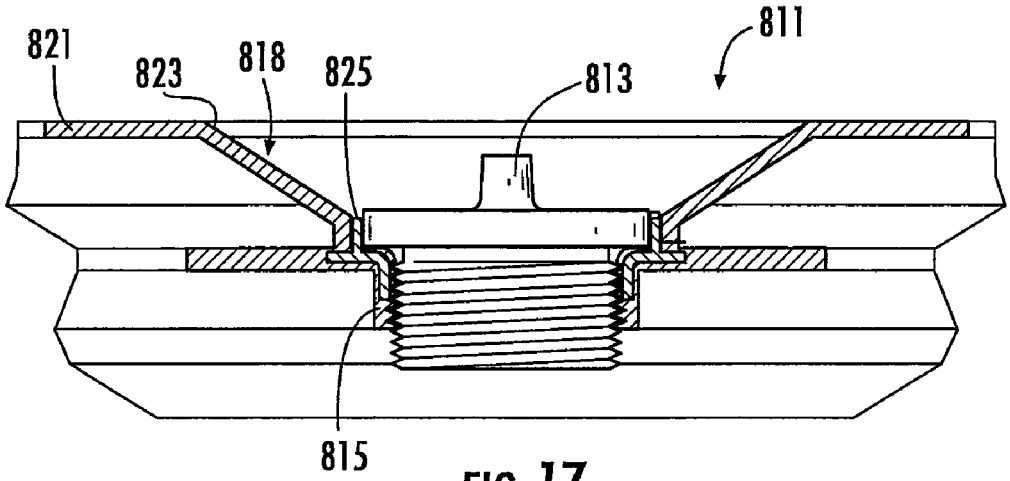
FIGS. 17 and 18 are various views of various features of an eight embodiment of the disclosure.
Figure 18:
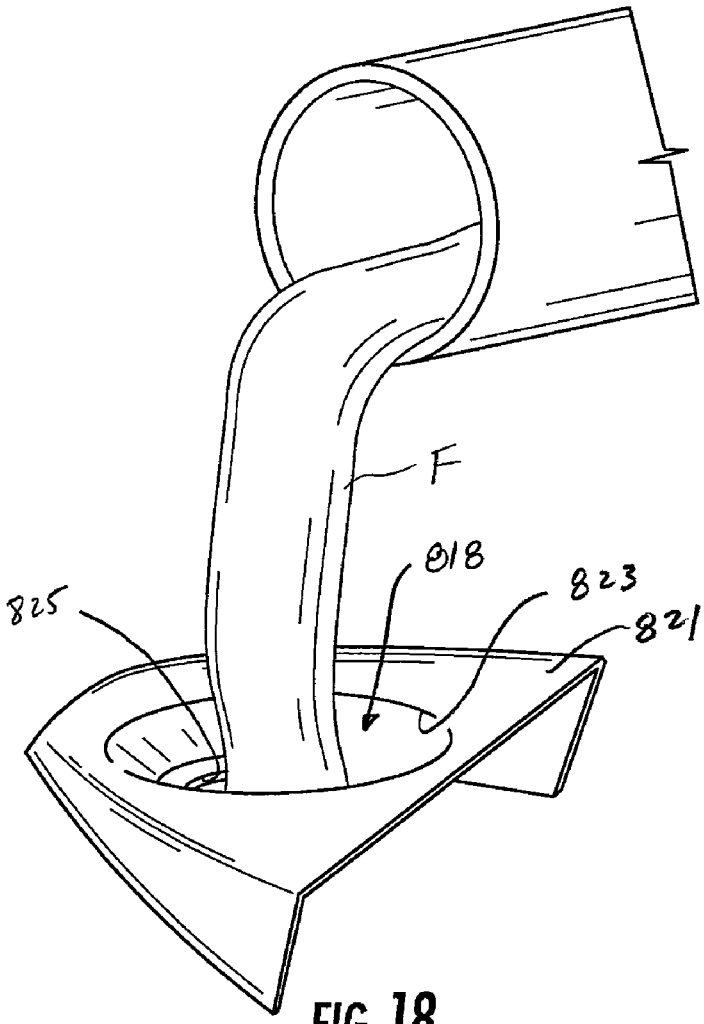
Figure 20:
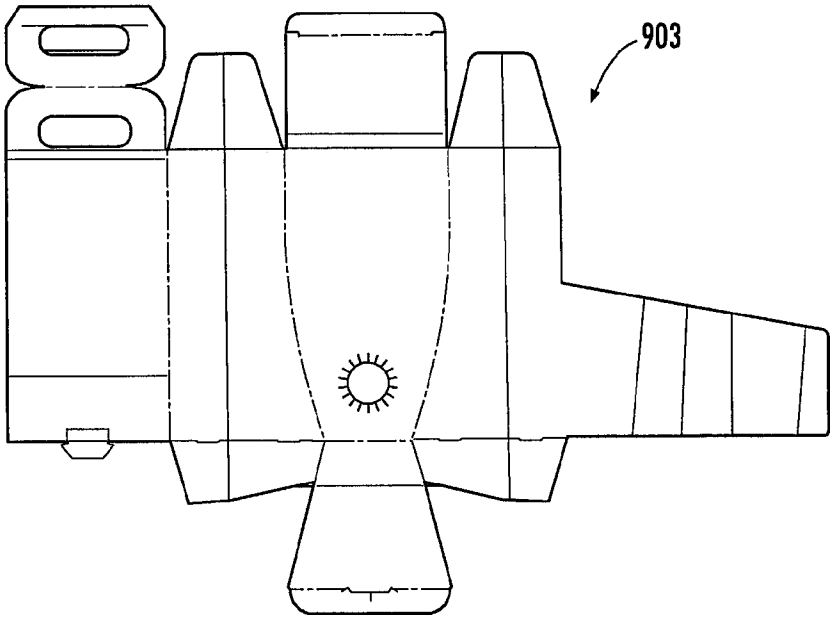
FIGS. 19-22 are various views of alternative embodiments and features of the disclosure.
Figure 19:
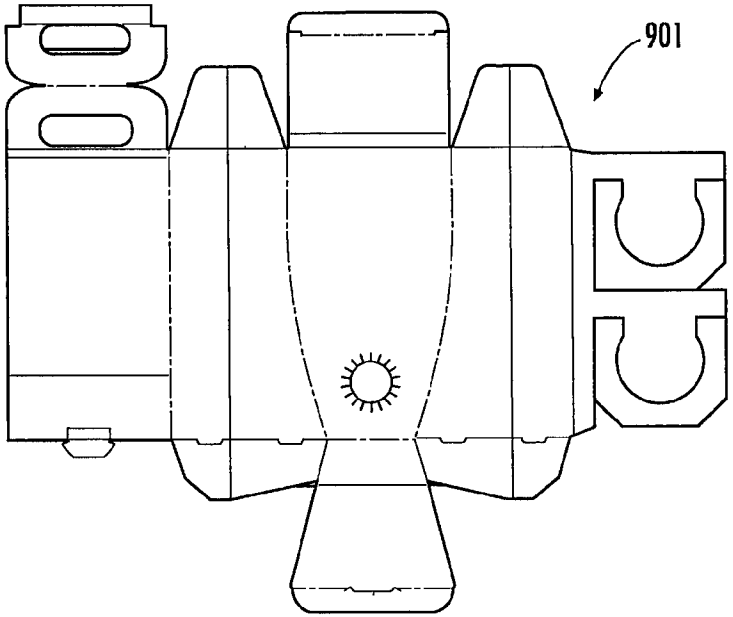
Figure 22:
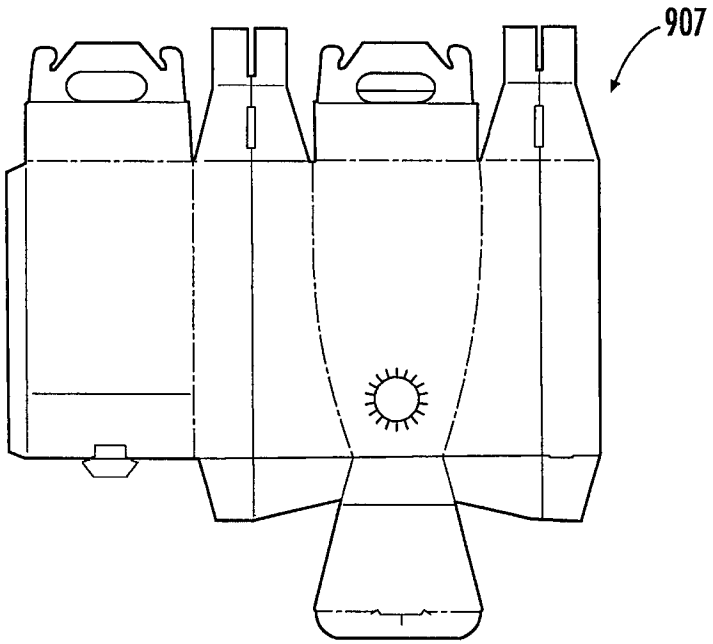
Figure 21:
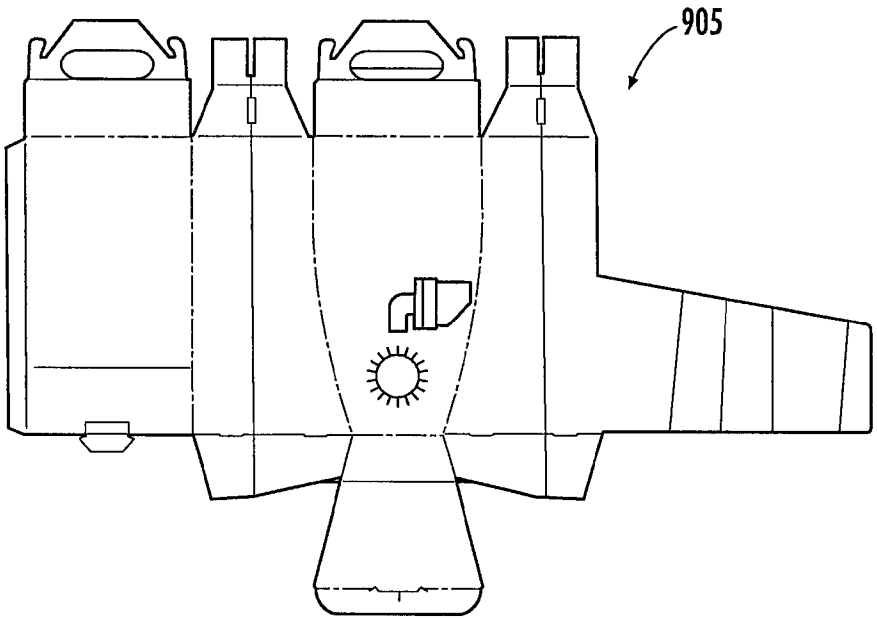

FIGS. 17 and 18 illustrate one embodiment of a fitment 811 that can be used with any of the embodiments of the carton shown herein. Further the fitment 811 could be used on other non-disclosed cartons, packages, or containers without departing from the scope of this disclosure. The fitment 811 includes a male plug 813 located in a funnel 818 similar to the funnels 618, 718 described herein. The funnel 818 angles inward from a front panel 821 and has a first opening 823 and a second opening 825. The first opening 823 is larger than the second opening 825. The fitment 811 includes a female connector 815 that is threadably connected to the male plug 813. The fitment 811 could be otherwise shaped, arranged, and/or configured without departing from the disclosure. The funnel 818 facilitates the filling of the carton with a flowable material (e.g., fluid F) when the fitment 811 has been removed or opened.

FIGS. 19-22 illustrate various alternative embodiments of blanks 901, 903, 905, 907 for forming cartons and packages that hold flowable material. The blanks 901, 903, 905, 907 shown in FIGS. 19-22 are generally similar to the above-described embodiments but have various alternative features. The blanks 901, 903, 905, 907 could be otherwise shaped arranged and configured without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the cartons, to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding and dispensing a flowable material, the carton comprises:

a plurality of panels for at least partially enclosing an interior of the carton, the plurality of panels comprises a front panel having an access opening for accessing the interior, a first side panel foldably connected to the front panel at a first fold line, a second side panel foldably connected to the front panel at a second fold line, and at least one back panel foldably connected to at least one of the first side panel and the second side panel at a third fold line;

a fluid dispensing mechanism that is positioned relative to the access opening for dispensing the flowable material; and a funnel attached to the front panel, the funnel comprises an intermediate panel that is at least partially in face-to-face contact with an exterior surface of the front panel and fingers that are foldably connected to the intermediate panel, the fingers extend inward from the intermediate panel to the interior of the carton.

2. The carton of claim 1 wherein the at least one back panel has at least one retention flap for holding a complimentary product adjacent an exterior surface of the carton.

3. The carton of claim 2 wherein the at least one back panel comprises a first back panel foldably connected to the first side panel and a second back panel foldably connected to the second side panel, the at least one retention flap being located in the second back panel.

4. The carton of claim 3 wherein the at least one retention flap comprises a first retention flap and a second retention flap.

5. The carton of claim 3 wherein the second back panel overlaps the first back panel and is adhesively secured to the first back panel.

6. The carton of claim 1 further comprising a plurality of end flaps respectively foldably connected to a respective panel of the plurality of panels, the end flaps are for closing an end of the carton.

7. The carton of claim 6 wherein the end is a top end and the end flaps are top end flaps comprising a first top end flap foldably connected to the front panel, a second top end flap foldably connected to the first side panel, a third top end flap foldably connected to the second side panel, and a fourth top end flap foldably connected to the at least one back panel.

8. The carton of claim 7 wherein the carton comprises a handle formed from the fourth top end flap, the fourth top end flap comprising a first handle portion foldably connected to the first back panel and a second handle portion foldably connected to the first handle portion.

9. The carton of 8 wherein one of the first handle portion and the second handle portion comprises a handle flap and the other of the first handle portion and the second handle portion comprises a handle opening for receiving the handle flap.

10. The carton of claim 8 wherein the first handle portion and the second handle portion are in face-to-face contact to form the handle extending generally upward from the back panel.

11. The carton of claim 7 wherein the carton comprises a handle formed from the first top end flap and at least one of the second top end flap and the third top end flap, the first top end flap comprising at least one handle flap foldably connected to the first top end flap, the at least one of the second top end flap and the third top end flap comprises a handle opening for receiving the handle flap.

12. The carton of claim 6 wherein the end is a bottom end and the end flaps comprise a first bottom end flap foldably connected to the front panel, a second bottom end flap foldably connected to the first side panel, and a third bottom end flap foldably connected to the second side panel.

13. The carton of 12 wherein the end flaps comprise a fourth bottom end flap foldably connected to the at least one back panel, at least one of the end flaps comprises a male locking flap and at least one of the end flaps comprises a female locking opening, the end flaps being at least partially overlapped to close the bottom end and the male locking flap being interlockingly engaged with the female locking opening.

14. The carton of claim 12 further comprising a male locking flap foldably connected to the at least one back panel, and at least one of the end flaps comprises a female locking opening, the end flaps being at least partially overlapped to close the bottom end and the male locking flap being interlockingly engage with the female locking opening.

15. The carton of claim 1 comprising a fourth fold line in the first side panel, and a fifth fold line in the second side panel, each of the fourth fold line and the fifth fold line is parallel to the third fold line.

16. The carton of claim 1 wherein the intermediate panel comprises a central portion with the fingers being foldably connected to the central portion at a curved fold line.

17. The carton of claim 16 wherein the intermediate panel comprises a first side flap foldably connected to the central portion, a second side flap foldably connected to the central portion, and a bottom flap foldably connected to the central portion.

18. The carton of claim 17 wherein the first side flap is in face-to-face contact with the first side panel and the second side flap is in face-to-face contact with the second side panel.

19. The carton of claim 1 wherein the fluid dispensing mechanism is a spigot that is operatively connected to a bag holding the flowable material.

20. The method of claim 1 wherein the blank further comprises a plurality of end flaps respectively foldably connected to a respective panel of the plurality of panels, the method further comprising positioning the end flaps to close an end of the carton.

21. The method of claim 20 wherein the end is a top end and the end flaps are top end flaps comprising a first top end flap foldably connected to the front panel, a second top end flap foldably connected to the first side panel, a third top end flap foldably connected to the second side panel, and a fourth top end flap foldably connected to the at least one back panel.

22. The method of claim 21 further comprising forming a handle from the fourth top end flap, the fourth top end flap comprising a first handle portion foldably connected to the first back panel and a second handle portion foldably connected to the first handle portion, one of the first handle portion and the second handle portion comprises a handle flap and the other of the first handle portion and the second handle portion comprises a handle opening for receiving the handle flap, the forming the handle comprises placing the first handle portion and the second handle portion in face-to-face contact.

23. The method of claim 21 further comprising forming a handle from the first top end flap and at least one of the second top end flap and the third top end flap, the first top end flap comprising at least one handle flap foldably connected to the first top end flap, the at least one of the second top end flap and the third top end flap comprises a handle opening for receiving the handle flap.

24. The method of claim 20 wherein the end is a bottom end and the end flaps comprise a first bottom end flap foldably connected to the front panel, a second bottom end flap foldably connected to the first side panel, and a third bottom end flap foldably connected to the second side panel.

25. The method of claim 24 wherein the end flaps comprise a fourth bottom end flap foldably connected to the at least one back panel, at least one of the end flaps comprises a male locking flap and at least one of the end flaps comprises a female locking opening, the method further comprising at least partially overlapping the end flaps to close the bottom end and placing the male locking flap in interlocking engagement with the female locking opening.

26. The method of claim 24 further comprising a male locking flap foldably connected to the at least one back panel, and at least one of the end flaps comprises a female locking opening, the method further comprising at least partially overlapping the end flaps to close the bottom end and placing the male locking flap in interlocking engagement with the female locking opening.

27. A blank for forming a carton for holding and dispensing a flowable material through a fluid dispensing mechanism, the blank comprises:

a plurality of panels comprising a front panel having an access opening, a first side panel foldably connected to the front panel at a first fold line, a second side panel foldably connected to the front panel at a second fold line, and at least one back panel foldably connected to at least one of the first side panel and the second side panel at a third fold line;

the access opening is for positioning of the fluid dispensing mechanism in the carton formed from the blank; and a funnel attached to the front panel, the funnel comprises an intermediate panel that is at least partially in face-to-face contact with an exterior surface of the front panel and fingers that are foldably connected to the intermediate panel, the fingers are for being extended inward from the intermediate panel to the interior of the carton formed from the blank.

28. The blank of claim 27 wherein the at least one back panel comprises a first back panel foldably connected to the first side panel and a second back panel foldably connected to the second side panel, the second back panel has at least one retention flap foldably connected to the second back panel for holding a complimentary product adjacent to the carton formed from the blank.

29. The blank of claim 28 wherein the at least one retention flap comprises a first retention flap and a second retention flap.

30. The blank of claim 27 further comprising a plurality of end flaps respectively foldably connected to a respective panel of the plurality of panels, the end flaps are at a marginal end of the blank and are for closing an end of the carton formed from the blank.

31. The blank of claim 30 wherein the marginal end is a top end and the end flaps are top end flaps comprising a first top end flap foldably connected to the front panel, a second top end flap foldably connected to the first side panel, a third top end flap foldably connected to the second side panel, and a fourth top end flap foldably connected to the at least one back panel.

32. The blank of claim 31 wherein the blank comprises handle features in the fourth top end flap, the fourth top end flap comprising a first handle portion foldably connected to the first back panel and a second handle portion foldably connected to the first handle portion.

33. The blank of claim 32 wherein one of the first handle portion and the second handle portion comprises a handle flap and the other of the first handle portion and the second handle portion comprises a handle opening for receiving the handle flap.

34. The blank of claim 31 wherein the blank comprises handle features formed in the first top end flap and at least one of the second top end flap and the third top end flap, the first top end flap comprising at least one handle flap foldably connected to the first top end flap, the at least one of the second top end flap and the third top end flap comprises a handle opening for receiving the handle flap.

35. The blank of claim 30 wherein the marginal end is a bottom end and the end flaps comprise a first bottom end flap foldably connected to the front panel, a second bottom end flap foldably connected to the first side panel, and a third bottom end flap foldably connected to the second side panel.

36. The blank of claim 35 wherein the end flaps comprise a fourth bottom end flap foldably connected to the at least one back panel, at least one of the end flaps comprises a male locking flap and at least one of the end flaps comprises a female locking opening, the male locking flap being for interlocking engagement with the female locking opening when the carton is formed from the blank.

37. The blank of claim 35 further comprising a male locking flap foldably connected to the at least one back panel, and at least one of the end flaps comprises a female locking opening, the male locking flap being for interlocking engagement with the female locking opening.

38. The blank of claim 27 comprising a fourth fold line in the first side panel, and a fifth fold line in the second side panel, each of the fourth fold line and the fifth fold line is parallel to the third fold line.

39. The blank of claim 27 wherein the intermediate panel comprises a central portion with the fingers being foldably connected to the central portion at a curved fold line, a first side flap foldably connected to the central portion, a second side flap foldably connected to the central portion, and a bottom flap foldably connected to the central portion.

40. The blank of claim 39 wherein the first side flap is in face-to-face contact with the first side panel and the second side flap is in face-to-face contact with the second side panel.

41. A method of forming a carton for holding and dispensing a flowable material, the method comprises:

obtaining a blank comprising a plurality of panels comprising a front panel having an access opening, a first side panel foldably connected to the front panel at a first fold line, a second side panel foldably connected to the front panel at a second fold line, and at least one back panel foldably connected to at least one of the first side panel and the second side panel at a third fold line;

positioning the plurality of panels to form an interior space of the carton;

positioning a fluid dispensing mechanism relative to the access opening so that the dispensing mechanism is in fluid communication with the interior space of the carton; and attaching a funnel to the front panel, the funnel comprises an intermediate panel that is at least partially in face-to-face contact with an exterior surface of the front panel and fingers that are foldably connected to the intermediate panel, the method further comprising positioning the fingers to extend inward from the intermediate panel to the interior of the carton.

42. The method of claim 41 wherein the at least one back panel has at least one retention flap for holding a complimentary product adjacent an exterior surface of the carton, the method further comprises positioning the retention flap to hold the complimentary product.

43. The method of claim 42 wherein the at least one back panel comprises a first back panel foldably connected to the first side panel and a second back panel foldably connected to the second side panel, the at least one retention flap comprising a first retention flap and a second retention flap foldably connected to the second back panel.

44. The method of claim 43 wherein the positioning the plurality of panels comprises placing the second back panel in an overlapping relationship with the first back panel and adhesively securing the second back panel to the first back panel.

45. The method of claim 41 wherein the intermediate panel comprises a central portion with the fingers being foldably connected to the central portion at a curved fold line, a first side flap foldably connected to the central portion, a second side flap foldably connected to the central portion, and a bottom flap foldably connected to the central portion.

46. The method of claim 45 further comprising placing the first side flap in face-to-face contact with the first side panel and placing the second side flap in face-to-face contact with the second side panel.

47. The method of claim 41 wherein the fluid dispensing mechanism is a spigot that is operatively connected to a bag holding the flowable material, the method comprises placing the bag in the interior space of the carton.

48. A carton for holding and dispensing a flowable material, the carton comprises:

a plurality of panels for at least partially enclosing an interior of the carton, the plurality of panels comprises a front panel having an access opening for accessing the interior, a first side panel foldably connected to the front panel at a first fold line, a second side panel foldably connected to the front panel at a second fold line, and at least one back panel foldably connected to at least one of the first side panel and the second side panel at a third fold line;

a plurality of top end flaps respectively foldably connected to a respective panel of the plurality of panels, the top end flaps are for closing a top end of the carton;

a plurality of bottom end flaps respectively foldably connected to a respective panel of the plurality of panels, the bottom end flaps are for closing a bottom end of the carton; and a fluid dispensing mechanism that is positioned relative to the access opening for dispensing the flowable material, wherein the third fold line is a lateral fold line and at least a portion of the first fold line is curved and at least a portion of the second fold line is curved so that the front panel has a first width at the top end of the carton between the first fold line and the second fold line and a second width at the bottom end of the carton between the first and the second fold line, the second width being greater than the first width.

49. The carton of claim 48 wherein the first fold line and the second fold line are curved inwardly so that the first fold line and the second fold line converge toward the fluid dispensing mechanism.

* * * * *